United States Patent [19]

Kunde

[11] 4,364,243

[45] Dec. 21, 1982

[54] CIRCULAR KNITTING MACHINE FOR THE PRODUCTION OF HIGH PILE FABRICS HAVING COMBED-IN FIBERS

[75] Inventor: Klaus Kunde, Kohlberg, Fed. Rep. of Germany

[73] Assignee: Sulzer Morat GmbH, Fed. Rep. of Germany

[21] Appl. No.: 187,637

[22] Filed: Sep. 16, 1980

[30] Foreign Application Priority Data

Sep. 27, 1979 [DE] Fed. Rep. of Germany ..... 2939082

[51] Int. Cl.[3] ..... D04B 9/14; D04B 35/32

[52] U.S. Cl. ..... 66/9 B; 66/166; 66/168

[58] Field of Search ..... 66/9 B, 147, 168, 166; 356/238

[56] References Cited

U.S. PATENT DOCUMENTS

| | | | |
|---|---|---|---|
| 2,993,351 | 7/1961 | Wheelock | 66/168 X |
| 3,065,615 | 11/1962 | Abrams | 66/166 |
| 3,276,227 | 10/1966 | Althaus et al. | 66/166 |
| 3,345,835 | 10/1967 | Nickell et al. | 66/166 |

FOREIGN PATENT DOCUMENTS

| | | | |
|---|---|---|---|
| 1046483 | 10/1966 | United Kingdom | 66/166 |

*Primary Examiner*—Wm. Carter Reynolds

[57] ABSTRACT

Circular knitting machine for the production of high pile fabrics having combed-in fabrics, having a needle cylinder with displaceably mounted knitting needles defining a circular knitting field along the upper edge of the cylinder, carding devices disposed along the knitting field, and an exhaust disposed above the knitting field. A lamp is fastened to the exhaust to illuminate the knitting field from within, and a mirror is fastened to the exhaust for the section-wise viewing of the inside of portions of the knitting field disposed on the side of an observer.

9 Claims, 2 Drawing Figures

Figure 1:
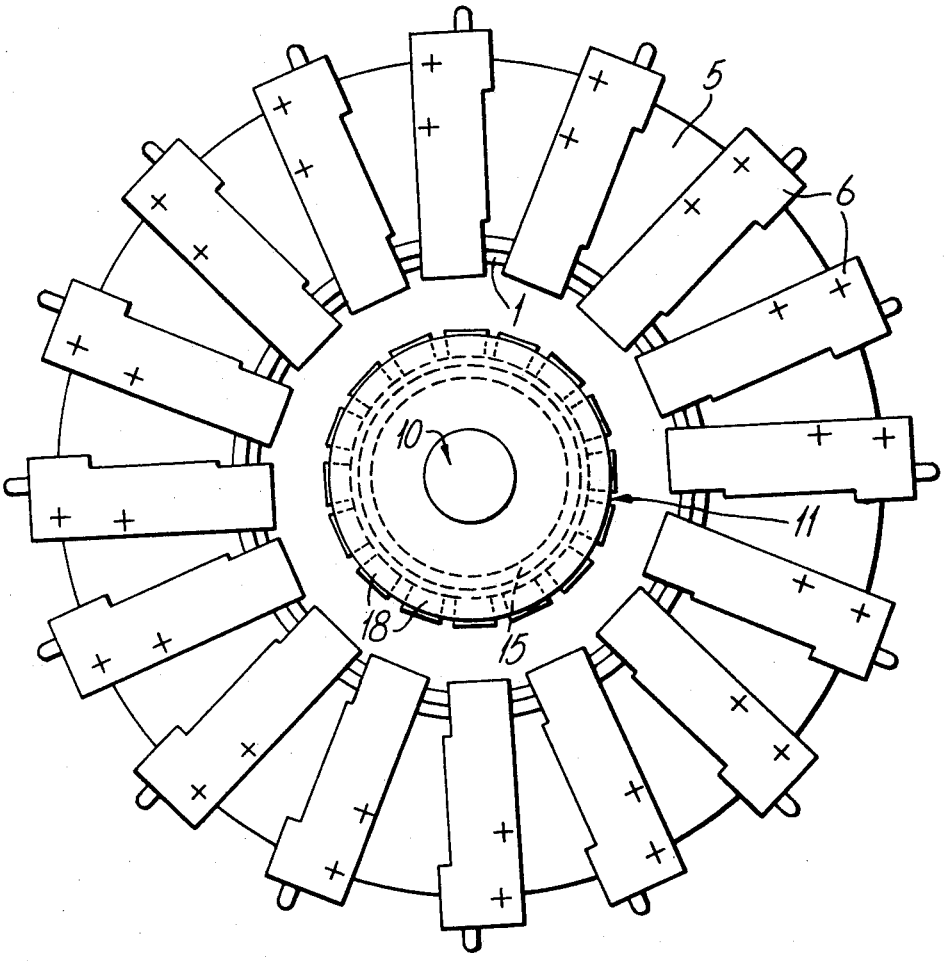

CIRCULAR KNITTING MACHINE FOR THE PRODUCTION OF HIGH PILE FABRICS HAVING COMBED-IN FIBERS

BACKGROUND

The invention relates to a circular knitting machine for the production of high pile fabrics having combed-in fibres, having a needle cylinder in which knitting needles are displaceably mounted which define a circular knitting field along the upper edge of the needle cylinder, and having a plurality of carding devices disposed along the knitting field and an exhaust means disposed above the knitting field.

In known circular knitting machines of this kind U.S. Pat. No. 3,999,405 dated Dec. 28, 1976, four to sixteen carding devices, as a rule, are disposed along the knitting field, consisting each of at least one feeder feeding a sliver, a carding cylinder, a combing cylinder and an evening or cleaning cylinder, and therefore they conceal the knitting area such that it is scarcely visible from the outside. In addition, the space above the needle cylinder is covered over by the exhaust device, so that the already poor visibility is further impaired by the insufficient entry of light. It is therefore not possible to observe the combing-in process, i.e., the passage of the knitting needles through the wires of the combing-in cylinders and thus the insertion of the fibers into the knitting needles, nor can the knitting process which directly follows the combing-in process be observed. This results in difficulty in the first setting up of the machine and in cases in which changes become necessary or trouble occurs during production.

The convenience of operation of the known circular knitting machines of the kind described in the beginning is furthermore, and aside from the poor lighting and visibility, limited by the fact that, after a carding device has been removed, only the portion of the knitting field opposite the removed carding device is directly visible. Therefore if, for example, too many or too few fibers are being fed at this opposite position, this problem could be seen, and could be eliminated by controlling the fiber feed. If, on the other hand, a needle fault, for example, is involved, which also might be seen when the defective needle moves past the area on the above-mentioned opposite side, the defective needle has to be shifted by turning the needle cylinder step by step to the portion of the knitting field that has been made accessible by the dismounting of the carding device, where the defective needle can be removed or replaced with a new needle. At the same time the difficulty arises that, at the location of the dismounted carding device only the fronts of the needles are visible and therefore the defective needle often cannot be identified at that location.

The greater the number of systems and hence carding devices that are provided on the circular knitting machine, the greater are the problems which have been described.

THE INVENTION

The invention is therefore addressed to the problem of increasing substantially the convenience of operation of a circular knitting machine of the kind specified above, and of improving lighting and visibility conditions such that the faults explained above, and others as well, can be easily found and eliminated.

To solve this problem the above mentioned circular knitting machine is provided with at least one lamp fastened to the exhaust means for the illumination of the knitting field from within and with a mirror fastened to the exhaust means for the section-wise viewing of the inside of portions of the knitting field disposed on the side of the observer.

The essential advantages of the invention are to be seen on the one hand in the fact that, by the illumination of the knitting field from the inside, the possibility is for the first time created of making faults of adjustment, operation or material visible in a manner which substantially facilitates for the operator the necessary constant supervision of the knitting process. On the other hand, the use of a mirror provides a view of parts of the working field from the inside, on the side of the needle cylinder facing the observer, so that, for example, faults discovered on the opposite side of the needle cylinder can be seen close-up by means of the mirror after about one half of a revolution of the needle cylinder.

Additional advantageous features of the invention are given in the subordinate claims.

The invention will be explained hereinbelow in conjunction with the appended drawing which shows an embodiment thereof.

Figure 2:
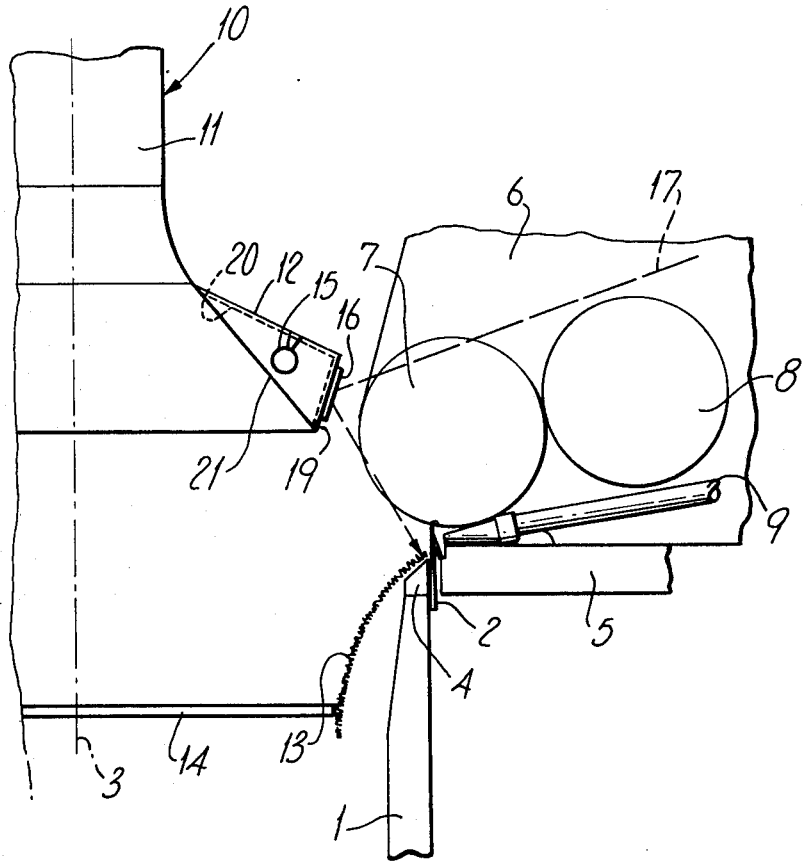

FIG. 1 is a diagrammatic plan view of a circular knitting machine of the invention, and FIG. 2 is a diagrammatic side view of a carding device of the circular knitting machine of FIG. 1.

As shown in FIGS. 1 and 2, the circular knitting machine, which is represented in highly simplified form, contains a rotatable needle cylinder 1 having knitting needles 2 which can be moved up and down, and a vertical axis 3. The top edge 4 of the needle cylinder 1 is surrounded by a coaxial annular cam base plate 5 on which the cams required for the operation of the needles 2 are fastened, as well as pattern devices if necessary. Furthermore, a plurality of carding devices 6 are fastened on the cam base plate 5, which in a known manner comb fibers into the knitting needles 2 and have, for this purpose, a combing roller 7, a carding cylinder 8 and a nozzle 9 through which compressed air is directed against the fibers combed into the needles 2.

The needles 2 define a knitting field situated above the upper edge 4 of the needle cylinder 1, and a plurality of knitting stations, each having as a rule one carding device 6, are provided as a rule along the knitting field. Above this knitting field there is provided an exhaust device 10, which has an exhaust hood 11 flaring downwardly and is provided with a marginal section 12 disposed just above the knitting field. The upper part of the exhaust hood is connected to a vacuum line which is not represented. The exhaust device 10 serves to draw off any dust-like particles and other impurities, plus any fibers that have been stripped off from the combing cylinder 7 but have failed to be combed into the needles 2 during the knitting of a tube of goods 13, and to keep them away from the knitting stations.

Beneath the knitting field and within the needle cylinder 1 there is provided a cover plate 14 which substantially covers the interior of the needle cylinder below the knitting field, without interfering with the passage of the tube of goods 13. The cover plate 14 consists in accordance with the invention of a material that transmits light.

In accordance with the invention, a lamp 15 and at least one mirror are fastened to the marginal section 12 of the suction hood 11, the lamp 15 serving for the illumination of the knitting field from the inside and the mirror 16 serving for viewing from the inside, section by section, parts of the knitting field that are on the observer's side thereof, as is indicated in FIG. 2 by a broken line 17.

The lamp 15 consists, as seen in FIGS. 1 and 2, preferably of a fluorescent ring light fastened to the bottom of the marginal section 12, and it is furthermore so disposed and constructed that its light passes through the cover plate 14 and illuminates the interior of the needle cylinder and hence also the tube of goods 13.

The mirror 16 consists best of a plurality of segments 18 each of which is associated with a carding device such that the operator is able, after removing a carding device, to observe from within, by means of the associated segment 18, in the line of sight indicated by the arrow 17, that portion of the knitting field which is situated between the two carding devices 6 directly adjacent the removed carding devices 6, i.e., to observe the backs of the needles 2. The individual segments 18 are, as shown in FIG. 2, fastened to a downwardly and inwardly extending portion 19 of the marginal section 12. The segments 18 can alternatively consist of a reflective material which is vacuum-deposited onto the portion 19.

The inner surfaces of the marginal section 12 are, as indicated by broken lines in FIG. 2, covered with a light-reflecting material 20 in order to avoid light losses and glare. Furthermore, the exhaust hood 11 has a light-transmitting cover plate 21 extending preferably smoothly as far as the upper edge of the marginal section to prevent accumulations of fibers around the lamp 15 and the mirror 16. To prevent soiling or fogging of the mirror 16 or segments 18, the portion 19 can consist of a light-transmitting material onto which the mirror 16 or segments 18 are mounted from the inside.

The invention makes possible, by observation between two carding devices 6, a constant control and supervision of the operation of at least one oppositely situated knitting system, i.e., the insertion of the fiber and the knitting process that follows, as well as the detection of faulty needles. Furthermore, on account of the internal lighting of the tube of goods 13, a constant quality control can be exercised. Lastly, at least after the removal of a carding device 6, at least one knitting system situated in the observer's direct vicinity can be viewed from the inside by means of the mirror.

The invention is not limited to the described embodiment, but can be modified in many ways. Instead of a lamp 15 in the form of a fluorescent ring light, different lamps can be provided depending on the exhaust hood 11 used in the particular case. Different mirrors 16 or combinations of mirrors can also be used. In particular, the mirror 16 can have segments fastened to a portion extending outward and upward instead of downward, from the marginal section 12 of the exhaust hood 11. Furthermore, the mirror or the individual segments can be so constructed and/or disposed that they additionally permit, or only permit, observation of portions of the knitting field from the inside by viewing through two adjacent carding devices 6, and on the side of the needle cylinder facing the observer instead of the side of the needle cylinder opposite the observer. Such an embodiment is recommended particularly in the case of circular knitting machines having comparatively few carding devices 6, which therefore need to be disassembled as a rule only when repairs are necessary.

Lastly, the cover plate 14 of the needle cylinder can also consist of an opaque material. The use of a light-transmitting cover plate, however, offers the additional advantage that no other lamp in addition to lamp 15 is required, even if it is desired that the tube of material 13 be illuminated also from the inside.

I claim:

1. Circular knitting machine for the production of high pile fabrics having combed-in fibers, having a needle cylinder in which knitting needles are displaceably mounted which define a circular knitting field along the upper edge of the needle cylinder, and having a plurality of carding devices disposed along the knitting field and an exhaust means disposed above the knitting field, characterized by at least one lamp (15) fastened to the exhaust means (10) for the illumination of the knitting field from within and by a mirror (16) fastened to the exhaust means (10) for the section-wise viewing of the inside of protions of the knitting field disposed on an side of the observer.

2. Circular knitting machine of claim 1, characterized in that the exhaust means (1) has an exhaust hood (11) having a lower, flaring marginal section (12) disposed closely above the knitting field, and that the lamp (15) and the mirror (16) are fastended to the marginal section (12).

3. Circular knitting machine of claim 1 or 2, characterized in that the lamp (15) consists of a circular fluorescent tube.

4. Circular knitting machine according to claim 3, characterized in that the circular fluorescent tube is fastened to the bottom of the marginal section (12).

5. Circular knitting machine according to any one of claims 1 or 2, characterized in that the mirror (16) has a number of segments (18) individually associated with the carding devices (6) corresponding to the number of the carding devices (6), and so disposed that, after the removal of a carding device (6) the entire portion of the knitting field corresponding to this carding device is visible from within by means of the corresponding segment (18).

6. Circular knitting machine according to claim 2, characterized in that the marginal section (12) has a portion (19) extending obliquely downward and inward, and that the segments (18) are fastened to the portion (19).

7. Circular knitting machine according to claim 2, characterized in that the lower or internal surfaces of the marginal section (12) are covered with a light-reflecting material (20).

8. Circular knitting machine according to claim 2, characterized in that the exhaust hood (11) has a light-transmitting and fiber accumulation-preventing cover plate (21) extending from the bottom edge of the portion (19) to the upper edge of the marginal section (12).

9. Circular knitting machine according to any one of claims 1, 2, 4, 7, or 8, characterized in that a light-transmitting cover plate (14) is provided which substantially covers the interior of the needle cylinder (1) below the knitting field, and that the lamp (15) is so constructed and/or disposed that it also illuminates the interior of the needle cylinder (1).

* * * * *